US006757991B2

(12) United States Patent
Sussmann

(10) Patent No.: US 6,757,991 B2
(45) Date of Patent: Jul. 6, 2004

(54) SHOE, ESPECIALLY A SPORTS SHOE

(75) Inventor: Reinhold Sussmann, Scheinfeld (DE)

(73) Assignee: Puma AG Rudolf Dassler Sport, Herzogenaurach (DE)

( * ) Notice: Subject to any disclaimer, the term of this patent is extended or adjusted under 35 U.S.C. 154(b) by 0 days.

(21) Appl. No.: 10/343,761

(22) PCT Filed: Jul. 25, 2001

(86) PCT No.: PCT/DE01/02775

§ 371 (c)(1),
(2), (4) Date: Feb. 4, 2003

(87) PCT Pub. No.: WO02/11575

PCT Pub. Date: Feb. 14, 2002

(65) Prior Publication Data

US 2003/0167655 A1 Sep. 11, 2003

(30) Foreign Application Priority Data

Aug. 4, 2000 (DE) ..... 200 13 472 U

(51) Int. Cl.[7] ..... A43C 11/00
(52) U.S. Cl. ..... 36/50.1
(58) Field of Search ..... 36/50.1, 50.5, 36/131, 58.5

(56) References Cited

U.S. PATENT DOCUMENTS

| | | | | | |
|---|---|---|---|---|---|
| 3,703,775 | A | * | 11/1972 | Gatti | 36/128 |
| 5,425,185 | A | * | 6/1995 | Gansler | 36/50.1 |
| 5,463,822 | A | * | 11/1995 | Miller | 36/50.1 |
| 5,469,640 | A | | 11/1995 | Nichols | |
| D381,495 | S | * | 7/1997 | Avar | D2/972 |
| 5,659,982 | A | * | 8/1997 | Muraoka et al. | 36/131 |
| 6,128,835 | A | * | 10/2000 | Ritter et al. | 36/50.1 |
| 2003/0051374 | A1 | * | 3/2003 | Freed | 36/50.1 |

FOREIGN PATENT DOCUMENTS

| | | |
|---|---|---|
| DE | 89 796 | 5/1972 |
| EP | 0 559 648 B1 | 6/1992 |
| JP | 10-57110 | 3/1998 |
| WO | WO 85/03207 | 8/1985 |
| WO | WO 98 06288 A | 2/1998 |

* cited by examiner

*Primary Examiner*—Ted Kavanaugh
(74) *Attorney, Agent, or Firm*—Nixon Peabody LLP; David S. Safran

(57) ABSTRACT

The invention relates to a shoe (1) with side lacing (2), a lacing or tensioning element (13) being pulled in a zigzag alternatingly through eyelets of two rows (4, 5) of eyelets (4.1, 4.2, 4.3 and 5.1, 5.2, 5.3) opposite one another, of which the first row (4) on the lace side (3) is on or above the sole (6), and the second row (5) likewise on the lace side (3), but opposite the first row (5) at a distance, is on a shield which runs over the instep (9), which shield has a location which can change relative to the instep (9). According to the object both quick closure and also quick loosening of this closure will be attainable. This is achieved in that the shield is a freely movable tension flap (8) which has an essentially stable shape, but which is flexurally elastic, and which on the side opposite the lace side (3), has a single pulling site (8.1 or 8.1.1) via which it is coupled to the shoe (1) with a tension connection (10) which can be locked and which is adjustable in its length (10.1).

29 Claims, 4 Drawing Sheets

SHOE, ESPECIALLY A SPORTS SHOE

This invention relates to a shoe, especially an athletic shoe with lateral lacing.

One such shoe is known from DD patent specification 89 796. There is a shield there over the instep; the shield covers the fastening means which is present under this shield for fastening the shoe to the foot. The shield is attached to the shoe at the front and forms a kind of covering tongue which has a number of eyelets on the two side edges. Opposite these eyelets is a series of other eyelets at a distance; they are provided in tabs which are attached to the upper. Depending on the lacing on the two sides the location of the shield and the thickness of the lacing can be changed. The shield and the assigned laces can also be intended as the sole closing means.

The closing of the shoe and loosening of the closure by means of the two laces is relatively complex and requires a large amount of time.

The object of this invention is to make lacing of the conventional type such that both quick closing and also quick loosening of the closure can be achieved.

By using a tension flap of essentially stable shape with a single pulling site location and a tension connection the tension flap can be quickly moved into the closed position with a short pull and optionally subsequent looping and can be likewise quickly loosened again by opening the loop. This is especially advantageous in shoes which are used for example in triathalon competitions since here the preparation times, i.e. the times required for putting these shoes on and taking them off, greatly influences the result of the competition.

Other advantageous details of the invention are given in the dependent claims and are described below using the embodiments shown in the drawings.

FIG. 1 shows a top view of a shoe as claimed in the invention,

FIG. 2 shoes a side view of the shoe shown in FIG. 1,

Figure 1:
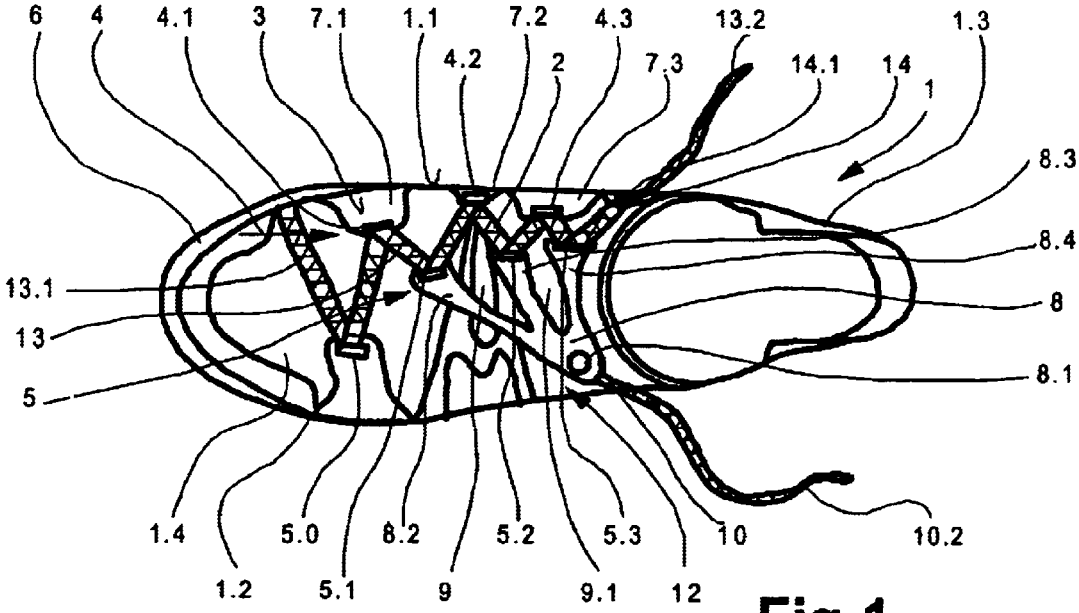
Figure 2:
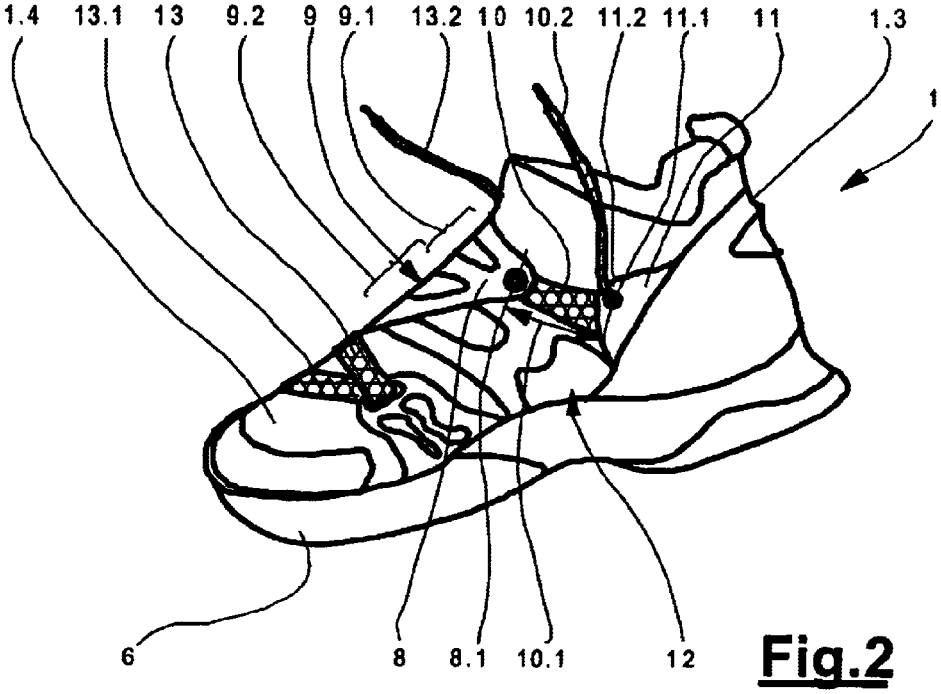

FIGS. 1 and 2 show a shoe 1 with side lacing 2. In the embodiment the lacing is provided on the lace side 3, here the inside 1.1 of the shoe 1. For the lacing 2 there are two rows 4 and 5 of eyelets 4.1, 4.2, 4.3 and 5.1, 5.2, 5.3. The first row 4 of eyelets is provided on the sole 6 in the area thereof or on at least one flap which projects upward and which is attached for example also to the upper of the shoe, or the illustrated flaps 7.1, 7.2, 7.3. The second row 5 of eyelets is attached at a distance from the first row of eyelets 4 to a shield which is freely movable over the instep 9 and which is made as a tension flap 8. The tension flap 8 itself has at the location opposite the row 5 of eyelets in the pulling direction a single pulling site 8.1 at which it is securely connected to a tension connection 10 which can be locked and changed in its length 10.1. The tension connection 10 which is made in the embodiment as a tension strip or tension cord for its part is looped through the eyelet 11.1 of the tension flap 11. The rear tension flap 11 is attached on the side opposite the lace side 3, here the outside 1.2 of the shoe 1. This outside 1.2 is the actual closing side 12 of the shoe 1, as will be explained below. The lace side 3 can with the same result also be on the outside 1.2 and the closing side 12 can be on the inside 1.1 of the shoe 1.

Preferably the rear tension flap 11 extends from the heel 1.3 of the shoe 1 in the pulling direction to the upper instep area 9.1 or to the middle instep area 9.2.

It can lie in an area in front of the ankle to underneath the ankle and it is connected movably or permanently to the shoe 1 or is dynamically connected to it such that it can be tensile-stressed in the closing direction. The eyelet 11.1 is located on its instep-side free end 11.2.

The tension flap 8 consists of a tensile-strong, flexurally elastic material with a low coefficient of friction. Plastics composed of or based on polyamide, polyethylene or polyurethane have proven suitable. But other plastics or materials are also suitable, for example, metals such as stainless steel, spring bronze, or the like. Preferably the tension flap 8 has a thickness of roughly 0.2 to 3 mm, especially roughly 0.3 to 2 mm. It can consist of a single plate. Advantageously however it has three or more fingers 8.2, 8.3, 8.4 which extend fan-like from the pulling site 8.1 to the lace side 3; on their free ends there is one eyelet 5.1, 5.2 or 5.3 of the second row 5 of eyelets at a time.

A shoelace 13 is pulled in a zigzag from one row to the other through the two rows 4 and 5 of eyelets. Its forward end 13.1 is first pulled through the frontmost eyelet 19.1 which is present on the closing side 12 and then attached on the lace side 3 in the area of the front shoe 1.4, preferably in the area of the sole 6, especially above it.

Attachment can however also take place after looping through the eyelet 5.1 if the flap 19 and its eyelet 19.1 are not considered necessary. In addition, attachment of the front end 13.1 of the shoelace 13 can take place after looping through the eyelet 4.1 on the closing side 12.

The rear free part 13.2 of the shoelace 13 is looped though an eyelet 14.1 of the tension flap 14 which can be tensile-loaded by the heel 1.3 to the upper instep area 9.1. It can be locked preferably in the closed position, but can also be locked in other positions.

Locking can also be undertaken on the shoe 1 on the lace side 3 or on the closing side 12 in a permanent or preferably variable manner. With a free choice of the length of the tensioning part of the shoelace 13, locking can take place according to the necessary lace tension, for example by attachment by means of a row of snap fasteners, a velcro hook and loop closure, a lever closure or by tying to the free end 10.2 of the tension connection 10. In the embodiment as shown in FIGS. 1 to 4 the attachment and lengthwise fixing by lacing takes place with the tension connection 10.

The free end 10.2 of the tension connection 10 which is made as a tension strip or tension cord can be connected to the rear free part 13.2 of the shoelace 13, for example by tying a loop, to one another.

The lacing as claimed in the invention works as follows:

When pulling on the rear free part 13.2 of the shoelace 13 the two rows 4 and 5 of eyelets are pulled against one another in the conventional manner. With this measure essentially the shoe 1 is matched to the shape of the foot. If at this point the free rear part 13.2 of the shoelace 13 is tied tightly to the free end 10.2 of the tension connection 10 into a loop, on the one hand the lacing 2 is slightly retensioned, but essentially the tension flap 8 is pulled in the direction of the heel 1.3 and thus prompt closing of the shoe 1 is achieved. Conversely, when the loop is being opened the tension flap 8 is immediately unloaded so that quick opening of the shoe 1 occurs without the lacing 2 having to be radically loosened. It also follows from the manner of operation of the lace arrangement and the execution of the tension flap 8 with the tension connection 10 that in the embodiment the outside 1.2 of the shoe is called the closing side 12 because the actual closing process and opening process occur here.

Lacing 2 need not absolutely take place on the side or the lace side of the shoe 1. It can also be located to the top as far as the instep 9 and possibly even beyond it as far as the closing side 12. This is dependent on the length 10.1 of the tension connection 10 which is required for closing.

Preferably the shoelace 13 consists of a material with a low coefficient of friction. For example, plastics composed of or based on polyamide, polyimide, polyacrylic or polyester are suitable. The tension connection 10 can also consist of these materials.

But advantageously the tension connection 10 with the free part 10.2 and the rear part 13.2 of the shoelace 13 consist of a material with a higher coefficient of friction or they are produced such that they have a higher coefficient of friction. In this way a better closing force of the loop to be tied can be produced. These parts can also consist of cotton. The rear part 13.2 of the shoelace 13 with the higher coefficient of friction is attached to the remaining part, for example by sewing or cementing the two shoelace parts 13, 13.2 to one another. The shoelace 13 and the tension connection 10 preferably consist of a woven or knit. The shoelace 13 is preferably made as a strip. A fabric strip which has stronger cross ribs, therefore which is produced in the manner of a rep material, has proven advantageous.

Figure 3:
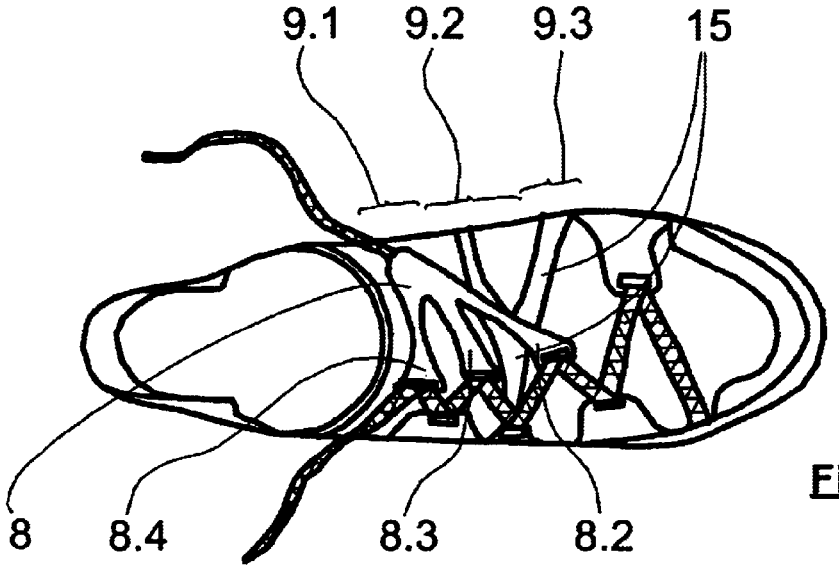
FIG. 3 shows a top view of a shoe with special tightening over the instep.
Figure 5:
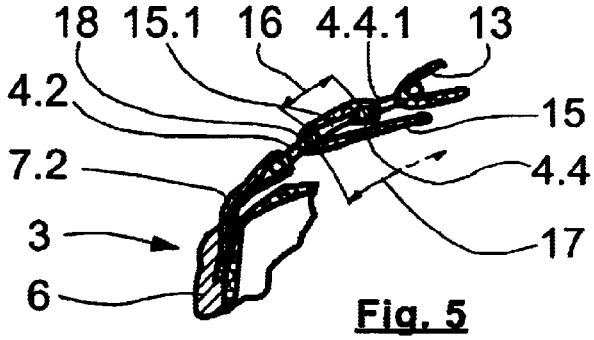
FIG. 5 shows an enlarged view of the circular extract of FIG. 4 in a front view in a section.
Figure 4:
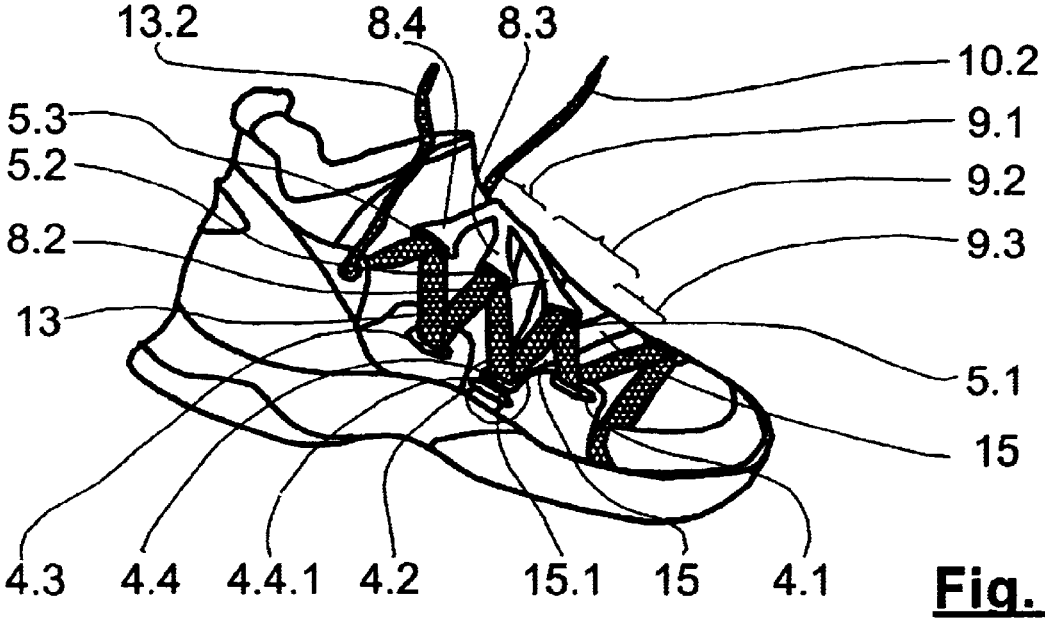
FIG. 4 shows a side view of the shoe as shown in FIG. 3.

According to one advantageous development of the invention, a further improvement of the lacing over the instep 9, for example in the middle instep area 9.2 or in the area of the middle foot, can be achieved by a special tension element 15, as is shown using FIGS. 3 to 5. The tension element 15 is attached on the closing side 12, for example in the sole area or upper area. The tension element 15 runs over the instep 9, preferably over the middle instep area 9.2 and/or optionally over the front instep area 9.3 or in the area of the front foot between the middle foot and the metatarsopharyngeal joints. The part of the tension element 15 which runs to the lace side 3 is looped with the end part 15.1 through one or through the especially rectangular eyelet 4.2 which is permanently attached to the shoe 1 and is permanently attached to a movable eyelet 4.4. The shoelace 13 is looped through the lace opening 4.4.1 of the movable eyelet 4.4.

This arrangement works as follows:

When pulling on the shoelace 13 the movable eyelet 4.4 is pulled in the direction of the instep 9. In this way the end part 15.1 of the tension element 15 which is attached to the eyelet 4.4 is likewise pulled in the direction to the instep 9 and in this way the distance 16 between the eyelets 4.2 and 4.4 is increased. Thus the pull length 17 of the tension element 15 between its attachment site on the shoe 1 and its winding 18 around the eyelet 4.2 is reduced and thus separate tightening over the instep 9 is achieved.

The tension element 15 consists of a material with tensile strength as great as possible, such as for example leather, textile material, or plastic. It can be attached to the material of the upper, for example sewed on and/or cemented on.

Instead of using a shoelace, to close the shoe a cable-like tension element can be used which can be actuated by a central turn-lock fastener, as is known for example from EP 0 559 648 B1.

Figure 6:
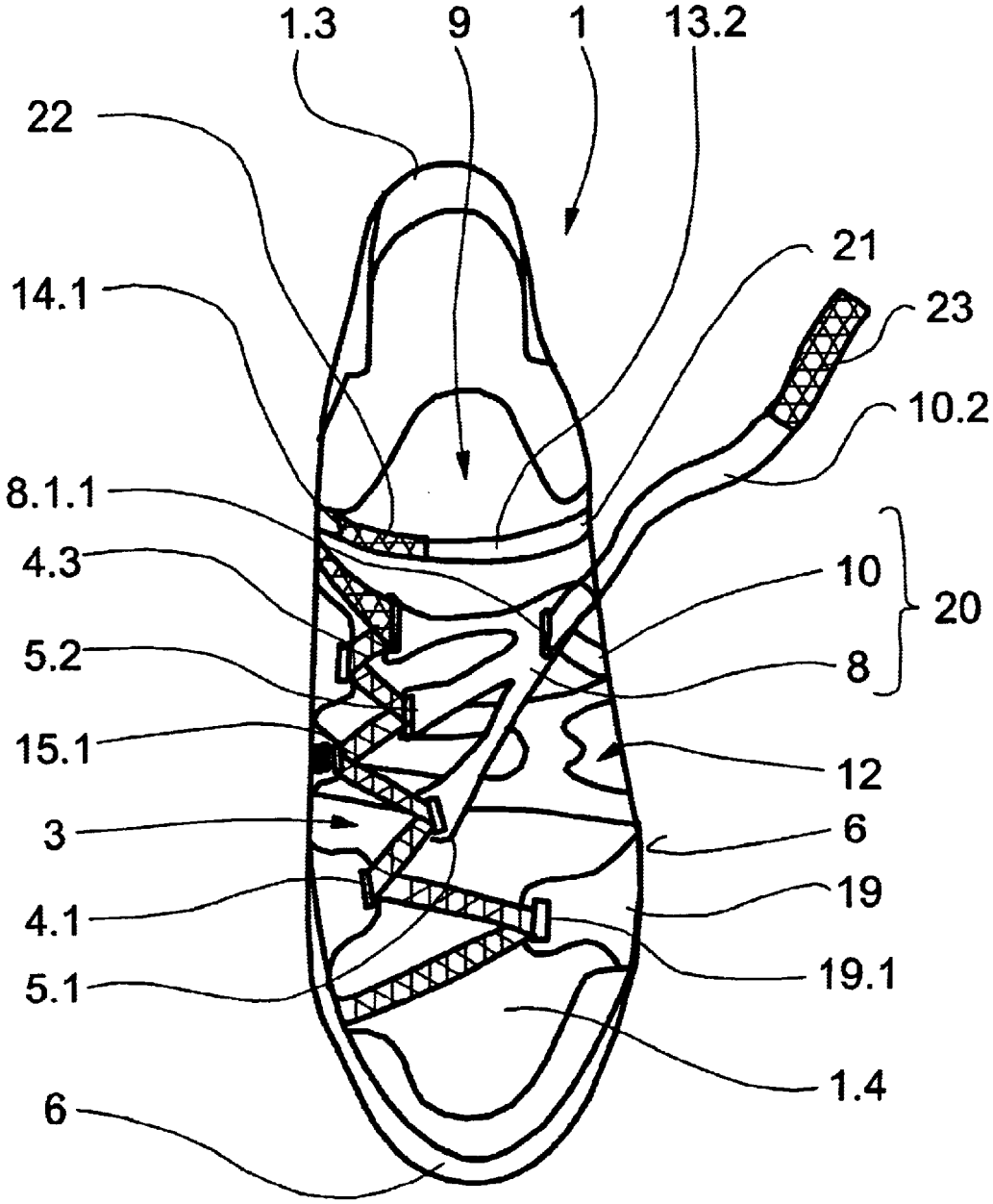
FIG. 6 shows in a top view another embodiment of a shoe as claimed in the invention and FIG. 7 shows a top view of the shoe as claimed in the invention as shown in FIG. 6, but with a central turn-lock fastener for opening and closing the side lacing.

In the embodiment shown in FIG. 6 a closure is shown in which the closing tension does not act as strongly towards the heel as in the embodiment as shown in FIGS. 1 to 4. Here the tension connection 10 in the middle shoe area 20 for the middle foot is attached to the shoe 1 directly or indirectly, for example via a flap or loop. Attachment takes place on or above the sole 6. The tension flap 8, instead of the pulling site 8.1, has an eyelet 8.1.1. The free end 10.2 of the tension connection 10 is first looped through the eyelet 8.1.1. of the tension flap 8 and then through the eyelet 11.1 of the rear tension flap 11 (see FIG. 2). Depending on whether the attachment of the tension connection 10 is farther forward or farther backward in the middle shoe area 20, the tensile stress can be aligned more or less in the direction transversely to the instep or more in the direction of the heel 1.3. The effect of quick opening and quick closing is fully maintained.

The free end 13.2 of the shoelace 13, as shown in FIG. 6, can be pulled from the rearmost eyelet 14.1 via the upper area 9.1 of the instep 9 to the closing side 12 and can be attached or can be attachable there preferably at roughly the same height or even lower, for example the attachment site 21. On the top of the free end 13.2 which crosses the instep a velcro hook and loop closure part 22 can be attached. Accordingly, on the bottom of the free end 10.2 of the tension connection 10 a velcro hook and loop closure part 23 is attached which forms the counterpart to the Velcro® hook and loop closure part 22. By fixed or adjustable attachment of the free end 13.2 and by pulling on the free end 10.2 of the tension connection 10, transfer over the instep 9 to the free end 13.2, and pressing the velcro hook and loop closure parts 22 and 23 onto one another, the ends 13.2 and 10.2 of the tension connection 10 are quickly and securely joined to one another in an easily detachable manner. Instead of the velcro hook and loop closure 22, 23, other types of quick closures can also be used.

For example, there can be rows of snap fasteners on one or both sides, an adjustable lever closure or conventional quick acting closures.

Figure 7:
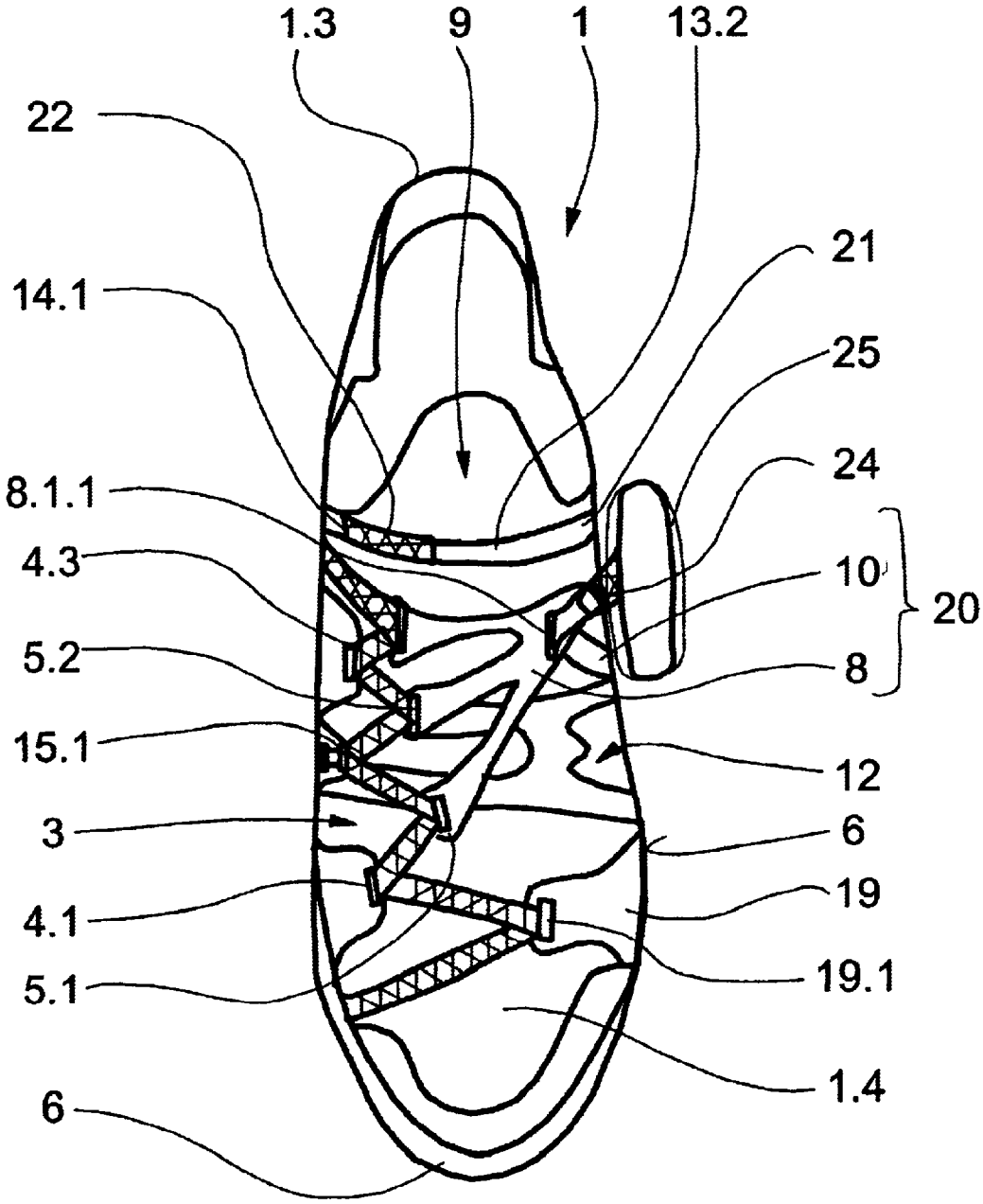

The use of a cable-like tension element 24 in conjunction with a central turn-lock fastener 25 as claimed in EP 0 559 648 B1 is possible in this embodiment, as is shown in FIG. 7.

What is claimed is:

1. Shoe, comprising:

a sole;

an upper attached to the sole;

a shield which runs over an instep area of the upper and which is movable relative to the instep area of the upper;

lacing eyelets arranged at a lacing side of the upper in two rows, a first row of which is on or near the sole, and a second row of which is located on a first side of the shield which is located near the first row of lacing eyelets, the second row being opposite the first row with the eyelets of the second row being longitudinally displaced relative to the eyelets of the first row; and a lacing or tensioning element laced in a zigzag path through the eyelets of rows, alternating between the eyelets of the first and second rows;

wherein the shield is a freely movable tension flap which has an essentially stable shape, but which is flexurally elastic, and wherein a second, closing side of the shield, which is opposite the first side, has a single pulling site via which the shield is coupled to the shoe upper by a tensioning connection which can be locked and which is adjustable in its length.

2. Shoe as claimed in claim 1, wherein the tensioning connection is coupled to the shoe upper such that, when the length of the tensioning connection is reduced, the tension flap is moved relative to the instep area in a manner applying a closing tension in a closing direction toward the heel on a closing side of the upper which is opposite the lacing side.

3. Shoe as claimed in claim 2, wherein the tensioning connection on the closing side in an area from in front of the ankle to underneath the ankle is connected to the shoe in a manner enabling tensile-stressing of the tensioning connection in the closing direction.

4. Shoe as claimed in claim 1, wherein the tensioning connection is permanently connected to the tension flap and a free end thereof is looped through a tensioning eyelet on a closing of the upper which is opposite the lacing side, the tensioning eyelet being located in an area from in front of the ankle to underneath the ankle.

5. Shoe as claimed in claim 1, wherein the pulling site of the tension flap is an eyelet and wherein the tensioning connection is looped through the eyelet of the tension flap from a connection in a mid-foot area of the shoe and then through a tensioning eyelet that is located rearward of the tension flap.

6. Shoe as claimed in claim 5, wherein one of a free end of the lace or tension element and a free end of the tensioning connection crosses the instep in an upper instep area from one side to the other side of the upper and the free ends the lace or tension element and of the tensioning connection are connectable by detachable connecting elements.

7. Shoe as claimed in claim 6, wherein the detachable connecting elements are one of a velcro hook and loop closure, at least one snap fastener closure, and an adjustable lever closure.

8. Shoe as claimed in claim 1, wherein the lace or tension element is looped through a frontmost eyelet that is attached at a front area of the shoe and a rear part of the lace or tension element is at least fixable after looping through a rearmost eyelet of the lace side in a closed position.

9. Shoe as claimed in claim 8, wherein the frontmost eyelet is on the closing side and wherein a front end of the lace or tension element is connected to the shoe on the lacing side.

10. Shoe as claimed in claim 1, wherein the tensioning connection is a tension strip or tension cord.

11. Shoe as claimed in claim 10, wherein the tension strip or tension cord is securely attached to the tension flap and is looped through a lace opening on the shoe, and wherein a free end of the tension strip or tension cord and a rear part of the lace or tension element are connectable to one another.

12. Shoe as claimed in claim 10, wherein the tension strip or tension cord is a woven or a knit shoe lace.

13. Shoe as claimed in claim 12, wherein the shoelace is a strip.

14. Shoe as claimed in claim 1, wherein the lace or tension element is made of a material with a low sliding friction at least in an area laced through the rows of eyelets.

15. Shoe as claimed in claim 14, wherein said material with a low sliding friction is from the group consisting of a polyamide, polyimide, polyacetate, polyacrylic, polyester and compounds thereof.

16. Shoe as claimed in claim 1, wherein the tensioning connection is a tension strip or tension cord, and a rear part of the lace or tension element have a relatively large coefficient of friction.

17. Shoe as claimed in claim 1, wherein the tension flap is made of a plastic with a low coefficient of friction.

18. Shoe as claimed in claim 17, wherein said plastic is from the group consisting of a polyamide, polyimide, polyethylene, polyurethane and compounds thereof.

19. Shoe as claimed in claim 17, wherein the tension flap has a thickness of roughly 0.2 mm to 3 mm.

20. Shoe as claimed in claim 17, wherein the tension flap has a thickness roughly 0.3 mm to 2 mm.

21. Shoe as claimed in claim 1, wherein the tension flap, toward the closing side, has a single pulling site and toward the lacing side has said second row with at least three eyelets.

22. Shoe as claimed in claim 2, wherein the tension flap has at least three fingers which extend from the pulling site toward the lacing side and a respective one of the at least three eyelets being provided on an end of each finger.

23. Shoe as claimed in claim 22, wherein the fingers are arranged in a fan-shaped manner from the pulling site toward the side.

24. Shoe as claimed in claim 1, wherein, on the closing side, a lacing flap extends from the heel in a direction toward the upper instep area, said flap has an instep-directed free end which is dynamically connected to the tensioning connection.

25. Shoe as claimed in claim 24, herein the free end of the lacing flap is provided with an eyelet through which a tension strip or the tension cord of which tensioning connection is formed is looped.

26. Shoe as claimed in claim 1, wherein the tension element is attached on the closing side and runs from there over the instep, said tension element being looped through a fixed tensioning eyelet on the lace side and being connected to a movable lace element, and wherein the lacing or tensioning element is looped through a lace opening of the movable lace element.

27. Shoe as claimed in claim 26, wherein a further tension element is provided in one of a mid-foot area and an area between the mid-foot area and a metatarsophalangeal joint area.

28. Shoe as claimed in claim 27, wherein the further tension element which is a tension flap made of a material selected from the group consisting of leather, a material with high tensile strength, and a plastic.

29. Shoe as claimed in claims 1 wherein the lacing or tensioning element and the tensioning connection comprise a cable-like tension element and wherein a turn-lock central fastener is provided for tightening thereof.

* * * * *